US011434589B2

(12) United States Patent
Simmendinger et al.

(10) Patent No.: US 11,434,589 B2
(45) Date of Patent: Sep. 6, 2022

(54) LATCH NEEDLE

(71) Applicant: Groz-Beckert KG, Albstadt (DE)

(72) Inventors: Roland Simmendinger, Strassberg (DE); Jürgen Veeser, Nusplingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 17/265,670

(22) PCT Filed: Jul. 30, 2019

(86) PCT No.: PCT/EP2019/070446
§ 371 (c)(1),
(2) Date: Feb. 3, 2021

(87) PCT Pub. No.: WO2020/025589
PCT Pub. Date: Feb. 6, 2020

(65) Prior Publication Data

US 2021/0301434 A1 Sep. 30, 2021

(30) Foreign Application Priority Data

Aug. 3, 2018 (EP) ..... 18187359

(51) Int. Cl.
*D04B 35/04* (2006.01)

(52) U.S. Cl.
CPC ..... *D04B 35/04* (2013.01)

(58) Field of Classification Search
None
See application file for complete search history.

(56) References Cited

U.S. PATENT DOCUMENTS 2,252,302 A * 8/1941 Morith ..... D04B 17/04 66/117
3,050,968 A * 8/1962 Masujima ..... D04B 35/04 66/121

(Continued)

FOREIGN PATENT DOCUMENTS

DE 1069812 B 11/1959
DE 2650985 A1 5/1977

(Continued)

OTHER PUBLICATIONS

European Patent Office; Search Report in related International Patent Application No. PCT/EP2019/070446 dated Oct. 14, 2019; 3 pages.

(Continued)

*Primary Examiner* — Khoa D Huynh
*Assistant Examiner* — Grace Huang
(74) *Attorney, Agent, or Firm* — Dorton & Willis, LLP

(57) ABSTRACT

A latch needle for a loop-forming textile machine includes a needle shank and a needle latch with a back. The needle shank has a slot for receiving the needle latch and a first contact portion adapted to the back. The needle latch is pivotably mounted on the needle shank about a pivot axis between an open position and a closed position. In the open position, the back bears against the first contact portion. The latch needle has a damping spring adapted to the back and/or to the first contact portion in order to damp a contact of the back of the needle latch when in the open position, against the first contact portion.

20 Claims, 4 Drawing Sheets

(56) References Cited

U.S. PATENT DOCUMENTS

| | | | | | |
|---|---|---|---|---|---|
| 4,026,126 | A * | 5/1977 | Nuber | D04B 1/02 | 66/9 R |
| 4,089,192 | A * | 5/1978 | Kohorn | D04B 35/04 | 66/123 |
| 4,791,794 | A | 12/1988 | Schmoll | | |
| 4,827,739 | A * | 5/1989 | Goller | D04B 7/04 | 66/106 |
| 5,201,198 | A * | 4/1993 | Kuhnert | D04B 35/06 | 66/120 |
| 5,239,844 | A | 8/1993 | Sos | | |
| 5,609,045 | A * | 3/1997 | Schmoll | D04B 35/04 | 66/116 |
| 5,956,976 | A * | 9/1999 | Schaffer | D04B 35/04 | 66/121 |
| 6,439,001 | B1 * | 8/2002 | Schaffer | D04B 35/04 | 66/121 |
| 6,510,714 | B2 * | 1/2003 | Dehner | D04B 35/04 | 66/121 |
| 6,792,775 | B2 * | 9/2004 | Wang | D04B 35/04 | 66/121 |
| 6,931,890 | B2 * | 8/2005 | Stingel | D04B 35/04 | 66/121 |
| 7,191,620 | B2 * | 3/2007 | Jurgens | B21G 1/04 | 66/121 |
| 7,272,958 | B2 * | 9/2007 | Fehrenbacher | D04B 35/04 | 66/121 |
| 7,624,598 | B2 * | 12/2009 | Dehner | D04B 35/04 | 66/121 |
| 2002/0043083 | A1 | 4/2002 | Schaffer | | |
| 2006/0075788 | A1 | 4/2006 | Jurgens et al. | | |

FOREIGN PATENT DOCUMENTS

| | | | |
|---|---|---|---|
| DE | 3702019 | C1 | 9/1987 |
| EP | 0547331 | A2 | 6/1993 |
| EP | 1197591 | A1 | 4/2002 |
| EP | 1645670 | A1 | 4/2006 |

OTHER PUBLICATIONS

European Patent Office; Written Opinion in related International Patent Application No. PCT/EP2019/070446 dated Oct. 14, 2019; 8 pages.

European Patent Office; Search Report in related European Patent Application No. 18187359.7 dated Feb. 1, 2019; 7 pages.

* cited by examiner

LATCH NEEDLE

CROSS-REFERENCE TO RELATED APPLICATIONS

This application is a national phase application under 35 U.S.C. § 371 of International Patent Application No. PCT/EP2019/070446, filed Jul. 30, 2019 (pending), which claims the benefit of priority to European Patent Application No. EP 18187359.7, filed Aug. 3, 2018, the disclosures of which are incorporated by reference herein in their entirety.

TECHNICAL FIELD

The invention relates to a latch needle for a loop-forming textile machine, the latch needle having a needle shank and a needle latch with a back, the needle shank having a slot for receiving the needle latch and a first contact portion adapted to the back, the needle latch being pivotably mounted on the needle shank about a pivot axis between an open position and a closed position and the back bearing against the first contact portion in the open position.

BACKGROUND

The document DE 1 069 812 B discloses a latch needle for knitting machines with a normal latch pivotably arranged in a slot in the needle shank, the latch spoon resting in the outermost back position of the latch on a recess in the needle shank which serves as a support, this recess being formed from an impression in the needle shank. The impression consists of projections of the walls of this slot which are produced by displacement of shank material into the interior of the needle shank slot. The impression extends to the full shank part behind the end of the needle shank slot. The embossing is adapted to the shape of the back of the spoon.

From the document DE 37 02 019 C1, a latch needle is known for loop-forming textile machines, with a needle shank and a needle hook adjoining it at the end, with a tongue slot formed in the needle shank and extending in the longitudinal direction of the needle shank and a needle latch pivotably mounted about a transverse pivot axis in the tongue slot at a bearing point and carrying at one end a latch spoon adjoining the latch blade and interacting with the needle hook in the latch closed position and the shank of which has an end part extending from the region of the bearing point up to the end facing away from the latch spoon, and with an elongated spring element, which is anchored in the region of its one end in a groove-like recess of the needle shank adjoining the tongue slot and protrudes with its other free end into the tongue slot and when the needle latch is in the closed position an associated support surface overlaps at the end part of the latch blade, the needle latch being able to be moved elastically by the spring element acting on it into a partially open intermediate position, in which the axes of the latch blade and the needle shank enclose an angle of preferably less than 90 degrees with each other, at which the end part of the latch blade adjoining the support surface for the end of the spring element has a free surface which opens into the upper side of the latch blade or its end part and releases the needle latch when it is pivoted from its intermediate position in the direction of its fully open position and which during this pivoting runs at a distance from the end face of the spring element which is otherwise disengaged from the end part of the latch blade.

In the case of the latch needle according to the document DE 37 02 019 C1, at the end of a pivoting movement the back of the latch blade of the needle latch bears on the spring element over a large area, the spring element being bent closed downwards a little when there is a continued expulsion movement of the latch needle by a loop pressing on the open needle latch until the needle latch reaches its end position. As soon as the loop releases the needle latch in the further course of the expulsion movement of the latch needle, the spring element returning to its starting position pivots the needle latch into an intermediate position in which it is held by the end of the spring element acting on the support surface.

From the document EP 0 547 331 A2, a latch needle for loop-forming textile machines is known, with a needle shank and a needle latch pivotably mounted in a tongue slot of the needle shank by means of a transverse axis and carrying at one end a latch spoon which adjoins a latch blade and interacts with the needle hook in the latch closed position and the latch blade being formed with a bearing bore and having an end part extending from the region of the bearing bore up to the end facing away from the latch spoon, and with an elongated spring element which is anchored to the needle shank in the region of its one end and with its other free end protrudes into the tongue slot and, at least when the needle latch is in the closed position, overlaps an associated support surface on the end part of the latch blade, the needle latch being elastically moved by the spring element engaging it into a partially open intermediate position at which the latch blade in the region of its end part has an open-edged opening reaching into the bearing bore and on the edge of which the support surface is arranged, and at which the latch blade is rigidly joined to the shaft rotatably mounted in corresponding bores in the needle shank cheeks delimiting the tongue slot.

In the case of the latch needle according to the document EP 0 547 331 A2, the rounded end part of the second leg engages the end of the spring element at the end of a pivoting movement, or else the arrangement is such that the back of the latch blade of the needle latch readily hangs up on the spring element. As the expulsion movement of the latch needle continues, the needle latch is then pressed downward by a loop bearing on it, so that the spring element is bent slightly when the needle latch reaches its end position.

The document EP 1 645 670 A1 relates to a latch needle with a tongue slot that widens towards the needle back and a spring swell which is arranged in the region of the tongue slot which widens towards the needle back. The ends of the spring swell are located in spring mounting pockets and a central, preferably flat, region of the spring swell bears against the end of the latch located in the tongue slot, and specifically preferably under pretension in order to stabilize a stable back position of the latch or else a position adjacent to the closed position.

The document EP 1 197 591 A1 discloses a latch needle with a latch and a spring which sets at least one stable rest position different from an end position. Two support surfaces on the latch and two pressure surfaces on the spring, which are assigned to one another, are used for this purpose. The spring is arranged in a tongue slot and extends past a bearing journal. Its two ends are supported in corresponding seats formed in the tongue slot. The spring has two bending points that represent the pressure surfaces against which the outer side (back) and inner side of the latch bear when it pivots into its end positions.

The document DE 26 50 985 A1 discloses a knitting needle with a latch and a spring fastened in the shank which spring engages the latch in an open position and supports it at a predetermined angle to the shank in such a way that it can be moved by a yarn moving away from the hook along the shank against the loading by the spring into an even more open position. The spring is a long, flat spring part which is fastened at one end to a needle shank and at the other end of which the latch can be brought into contact. The most open position of the latch is delimited by an edge surface of the shank.

SUMMARY

The object of the invention is structurally and/or functionally improving a latch needle mentioned at the outset.

The object is achieved with a latch needle having the features of claim 1. The dependent claims relate to advantageous designs and developments.

The latch needle can be a knitting needle or a weaving needle. The latch needle can be a short-latch needle. The textile machine can be a knitting machine or a weaving machine. The textile machine can be a circular knitting machine, in particular a large diameter circular knitting machine. The textile machine can be a high-speed circular knitting machine, for example a circular knitting machine that runs at up to 100 rpm.

The latch needle can have a needle back and a needle upper side. The latch needle can have a needle hook. The needle hook can be opened towards the upper side of the needle. The needle hook can have a closing portion cooperating with the needle latch. The latch needle can have a needle butt. The needle shank can have a first end and a second end. The needle hook can be arranged at the first end of the needle shank. The needle butt can be arranged at the second end of the needle shank.

The needle latch can have a closing portion cooperating with the needle hook. The needle latch can have a first end and a second end. The needle latch can be mounted at its first end. The closing portion can be arranged at the second end of the needle latch. The needle latch can be short. For example, the needle latch can have a length of approximately 2.5 mm to approximately 3 mm between its mounting and its closing portion.

The back can have an at least approximately arcuate contour. The back can have a contact portion. The contact portion of the back can have an arc radius that is larger than the arcuate contour. The contact portion of the back can be straight. The terms "arcuate contour" and/or "straight" are to be understood in this context in particular with respect to a longitudinal extension of the needle latch. The back can have a convex shape, at least in portions, in particular in the region of the closing portion of the needle latch.

The slot can be delimited laterally by two cheeks. The slot can be open towards the upper side of the needle. The slot can have an arcuate bottom. The slot can have a back opening directed towards the back of the needle. The back opening can be arranged in the region of the needle latch.

The first contact portion can have a contour that corresponds in a geometrically complementary manner to the back. The first contact portion can extend at least approximately over an entire width of the needle latch. In the present case, a width direction corresponds to an extension direction of the pivot axis. The first contact portion can be produced by plastic deformation of the needle shank, in particular the cheeks, in portions. The first contact portion can have a concave shape. The first contact portion can be designed in such a way that, in the open position, there is an enlarged contact surface between the first contact portion and the back. The first contact portion can be designed in such a way that, when the back is placed against the first contact portion in the open position, a reduced contact force in relation to area results.

The needle hook can be open in the open position. In the closed position, the closing portion of the needle latch and the closing portion of the needle hook can bear against one another. In the closed position, the needle hook can be closed with the aid of the needle latch.

The damping spring can be made from a resilient material, in particular from a spring wire. The damping spring can be made of a material having a rounded cross section, in particular having a circular cross section. The damping spring can be flattened laterally. The damping spring can be flattened on two opposite sides. The damping spring can be flattened on sides associated with cheeks delimiting a slot of a needle shank. The damping spring can be geometrically adapted to the back and/or the first contact portion. The damping spring can be adapted to the back and/or the first contact portion with regard to its damping effect. The damping spring can be adapted to the back and/or the first contact portion in such a way that, when the needle latch is pivoted in the direction of the open position, the back of the needle latch, in particular the contact portion of the back, first comes into mechanical contact with the first end of the second contact portion or the end of the damping spring on the contact portion side; the second contact portion then compresses, a pivoting movement of the needle latch being delayed and a contact region between the back, in particular the contact portion of the back, and the second contact portion increasing; the back, in particular the contact portion of the back, then comes into contact at least almost completely with the second contact portion and/or at the same time or subsequently the back, in particular the contact portion of the back, also comes at least almost completely into contact with the first contact portion. The damping spring can be adapted to the back and/or the first contact portion in such a way that when the open position is reached, transition from contact between the needle latch on the one hand and the damping spring on the other hand to contact between the needle latch on the one hand and the damping spring and the needle shank on the other hand takes place with as much reduction in force peaks as possible. The damping spring can in portions, in particular on a second contact portion, have a contour that corresponds geometrically to the back and/or a contour that corresponds to the first contact portion. The damping spring can be designed in such a way that dirt which penetrates the slot from above can escape downwards out of the slot between a latch bearing and the spring, but also in front of the latch bearing.

The damping spring can serve to delay a pivoting movement of the needle latch before the back of the needle latch comes to bear against the first contact portion in the open position. The damping spring can serve to reduce a pivoting speed of the needle latch with reduced gradient. The damping spring can serve to intercept a pivoting movement of the needle latch with reduced acceleration.

The damping spring can have a connecting portion. The connecting portion can be assigned to the needle shank. The connecting portion can be at least approximately straight. The connecting portion of the damping spring can be firmly connected to the needle shank. The connecting portion of the damping spring can be connected to the needle shank with a force fit, form fit and/or material fit. The damping spring can have a second contact portion. The second contact portion can be assigned to the back and/or the first contact portion. The second contact portion can be at least approximately straight. The second contact portion can be shorter than the connecting portion. The second contact portion can have a first end and a second end. The first end of the second contact portion can be freely resilient. The second end of the second contact portion can be constrained. The first end of the second contact portion can also be referred to as the end of the damping spring on the contact portion side. The connecting portion and the second contact portion can be arranged at an angle to one another. The angled arrangement can be used to adapt the damping spring to the back and/or the first contact portion.

The connecting portion and the second contact portion can be arranged at an angle of at least 15 degrees to one another, in particular at an angle of approximately 20 degrees to approximately 40 degrees. In the present case, the angle is to be understood as an angle deviating from a straight line, corresponding to an angle of 0 degrees. The connecting portion and the second contact portion thus form a corresponding supplementary angle. The connecting portion and the second contact portion can transition into one another in an arcuate manner.

The connecting portion can be arranged at least approximately parallel to the upper side of the needle. The connecting portion can be arranged to run along the upper side of the needle. The first contact portion and the second contact portion can be arranged at least approximately parallel to one another. The first contact portion and the second contact portion can be arranged at a distance from one another if the needle latch is not pivoted into the open position.

The damping spring can have an end on the contact portion side. The end of the damping spring on the contact portion side can also be referred to as the first end of the second contact portion. The end on the contact portion side can be arranged in alignment with the first contact portion. The end on the contact portion side can be arranged as an extension of the first contact portion.

The latch needle can have a bearing journal for pivotably mounting the needle latch on the needle shank. The second contact portion can be arranged in the height direction in the region of the bearing journal. In the present case, a height direction is a direction perpendicular to the pivot axis and to an extension direction of a longitudinal axis of the needle shank. A parallel projection of the second contact portion onto the bearing journal can at least approximately correspond to a diameter of the bearing journal. A width of the second contact portion can at least approximately correspond in section to a diameter of the bearing journal.

In the open position, the needle latch over at least a quarter of its length, in particular over approximately a third of its length, can bear against the second contact portion. When the needle latch is applied with the back in the open position, a maximum contact force can be reduced by approximately 30 to 70 percent, in particular by approximately 50 percent, with the aid of the damping spring. The remaining part of the contact force can be absorbed with the aid of the first contact portion. The cheeks delimiting the slot can spring open.

When the needle latch is pivoted in the direction of the open position, the back of the needle latch, in particular the contact portion of the back, first comes into mechanical contact with the first end of the second contact portion or the end of the damping spring on the contact portion side. The second contact portion then compresses, a pivoting movement of the needle latch is then delayed and a contact region between the back, in particular the contact portion of the back, and the second contact portion gets larger. The back, in particular the contact portion of the back, then comes to bear at least approximately completely against the second contact portion. At the same time or subsequently, the back, in particular the contact portion of the back, also comes to bear at least approximately completely against the first contact portion.

The damping spring is primarily designed to delay a pivoting movement of the needle latch in such a way that the back of the needle latch, when in the open position, bears against the first contact portion. Any associated restoring force acting on the needle latch in the direction of the closed position is subordinate and not the subject of the design of the damping spring.

In particular, optional features of the invention are designated by "can." Accordingly, there is in each case one embodiment of the invention which has the respective feature or features.

With the invention, a loading capacity of the latch needle is increased. A maximum runtime is increased. Damage can be prevented. Noise can be reduced. Downtimes can be reduced. An expenditure, such as time and/or cost expenditure, is reduced. Productivity is increased. Load peaks are reduced. Dynamic loads are reduced. A load acting on a bearing journal is reduced.

Embodiments of the invention are described in more detail below with reference to figures. Further features and advantages emerge from this description. Specific features of these embodiments can represent general features of the invention. Features of these embodiments that are connected to other features can also represent individual features of the invention.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
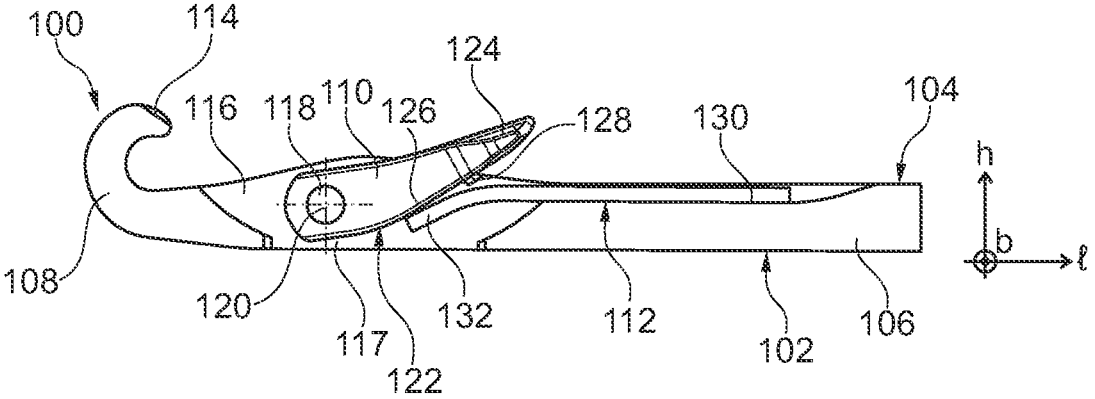
FIG. 1 shows a detail of a latch needle having a needle shank, a needle latch and a damping spring when pivoting in the direction of an open position.

FIG. 1 shows a detail of a latch needle 100. The latch needle 100 is used as a knitting needle in a large diameter circular knitting machine running at up to 100 rpm.

The latch needle 100 extends in a longitudinal direction l, a width direction b and a height direction h. The latch needle 100 has a needle back 102, an upper side of the needle 104, a needle shank 106, a needle hook 108, a needle latch 110 and a damping spring 112. The needle back 102 is arranged at the bottom in the height direction h. The upper side of the needle 104 is arranged at the top in the height direction h. The needle shank 106 extends along a longitudinal axis running in the longitudinal direction l. The needle hook 108 is open towards the upper side of the needle 104 and has a closing portion 114.

The needle shank 106 has a slot 116 in which the needle latch 110 is received. The slot 116 is laterally delimited by two cheeks, is open towards the upper side of the needle 104 and has an arcuate base and a back opening 117 directed towards the needle back 102.

The needle latch 110 is mounted pivotably about a pivot axis 120 on the needle shank 106 between an open position and a closed position with the aid of a bearing journal 118. The needle latch 110 has a back 122 and a closing portion 124. In the present case, the needle latch 110 has a short length of approximately 2.5 mm to approximately 3 mm between the pivot axis 120 and the closing portion 124. The back 122 has an arcuate contour with a contact portion 126. The contact portion 126 has an arc radius that is larger than the arcuate contour or is straight.

The needle shank 106 has a contact portion 128. The contact portion 128 of the needle shank 106 has a contour that corresponds in a geometrically complementary manner to the back 122 and is produced as a shape impression by plastic deformation of the needle shank 106 in portions.

The damping spring 112 is made from a spring wire and has a connecting portion 130 and a contact portion 132. The connecting portion 130 of the damping spring 112 is fixedly joined to the needle shank 106, the connecting portion 130 being arranged along the upper side of the needle 104 and running approximately parallel thereto. To accommodate the damping spring 112, the slot 116 is extended in the direction of the needle butt. The contact portion 132 has a freely resilient end and a constrained end.

The contact portions 128, 132 are arranged approximately parallel to one another. If the needle latch 110 is not pivoted into the open position, the contact portion 132 projects towards the needle latch 110 beyond the contact portion 128. The freely resilient end of the contact portion 132 is arranged in alignment with the contact portion 128.

Figure 2:
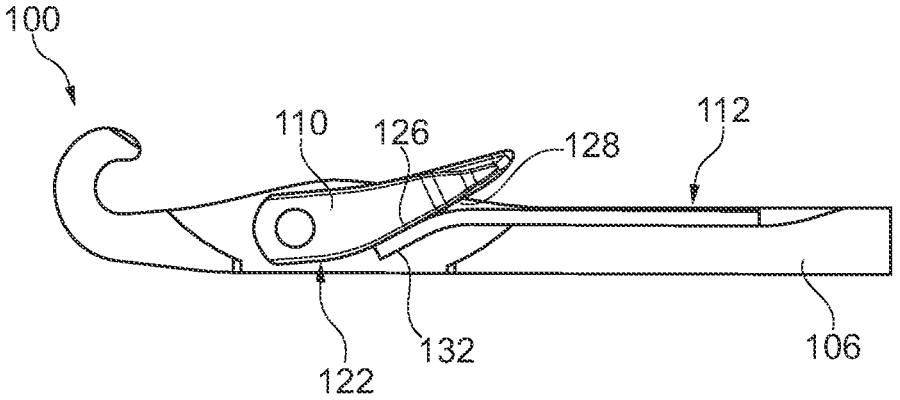
FIG. 2 shows a detail of a latch needle having a needle shank, a needle latch and a damping spring in an open position.

In the closed position (not shown), the closing portion 124 of the needle latch 110 and the closing portion 114 of the needle hook 108 bear against one another, so that the needle hook 108 is closed. When the needle latch 110 is pivoted in the direction of the open position, the contact portion 126 of the back 122 of the needle latch 110 first comes into mechanical contact, as shown in FIG. 1, with the freely resilient end of the contact portion 132 of the damping spring 112. The contact portion 132 of the damping spring 112 then compresses, thereby delaying a pivoting movement of the needle latch 110, and a contact region between the contact portion 126 of the back 122 and the contact portion 132 of the damping spring 112 gets progressively larger. The contact portion 126 of the back 122 then comes to bear against the contact portion 132 of the damping spring 112. At the same time or subsequently, the contact portion 126 of the back 122 also comes to bear against the contact portion 128 of the needle shank 106, as shown in FIG. 2.

With the aid of the damping spring 112, a pivoting movement of the needle latch 110 is delayed in such a way that an application of the back 122 of the needle latch 110 against the contact portion 128 of the needle shank 106 in the open position is damped. A pivoting speed of the needle latch 110 is reduced uniformly while avoiding acceleration peaks.

Figure 3:
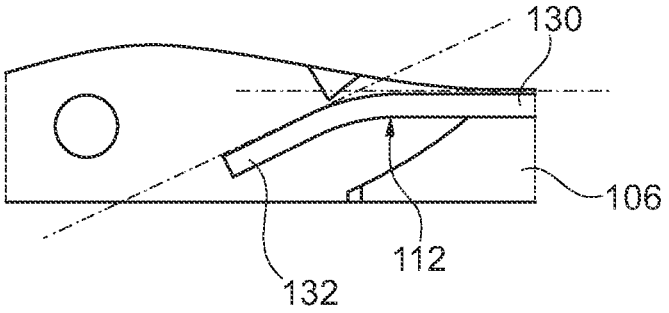
FIG. 3 shows a detail of a needle shank and a damping spring of a latch needle.

FIG. 3 shows a detail of the needle shank 106 and the damping spring 112 of the latch needle 100. The connecting portion 130 and the contact portion 132 of the damping spring 112 are each straight and in the present case are arranged at an angle of approximately 30 degrees to one another and transition into one another in an arcuate manner.

Figure 4:
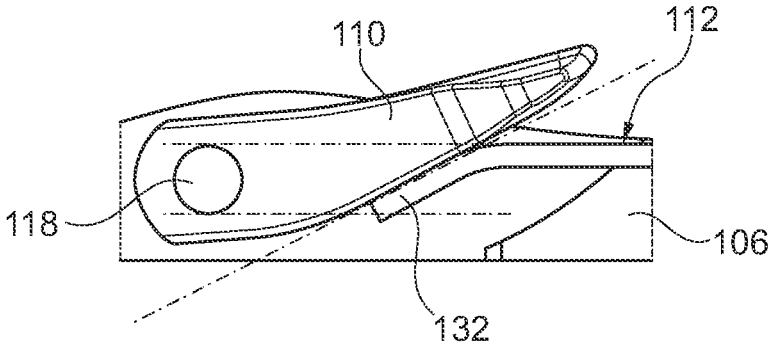
FIG. 4 shows a detail of a needle shank, a needle latch and a damping spring of a latch needle in an open position.

FIG. 4 shows a detail of the needle shank 106, the needle latch 110 and the damping spring 112 of the latch needle 100 in the open position. A parallel projection of the contact portion 132 of the damping spring 112 in the longitudinal direction onto the bearing journal 118 corresponds approximately to a diameter of the bearing journal 118.

Figure 5:
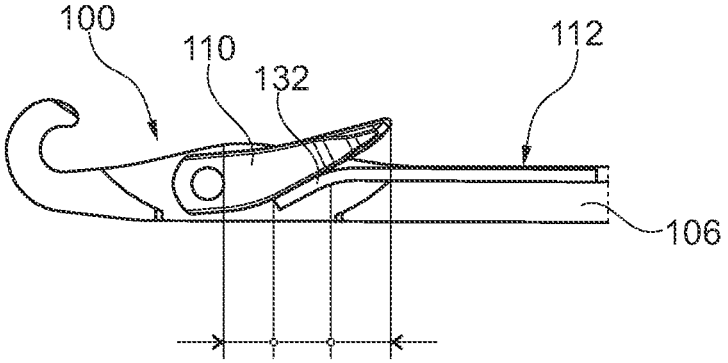
FIG. 5 shows a detail of a latch needle having a needle shank, a needle latch and a damping spring in an open position.

FIG. 5 shows a detail of the latch needle 100 with the needle shank 106, the needle latch 110 and the damping spring 112 in the open position. In the open position, approximately one third of the length of the needle latch 110 bears against the contact portion 132 of the damping spring 112.

Figure 6:
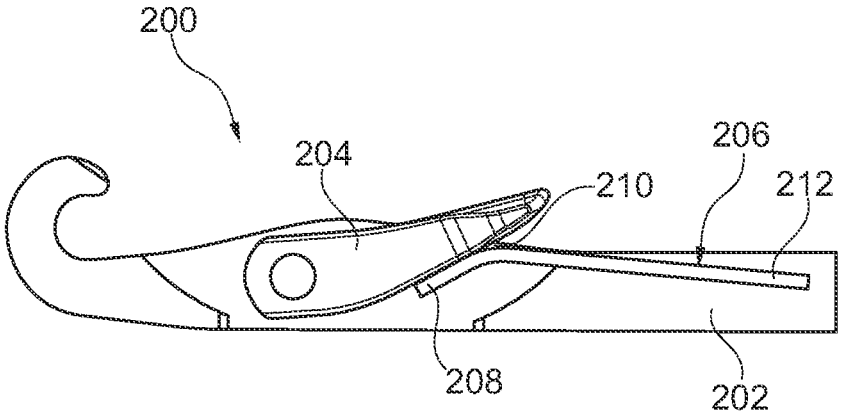
FIG. 6 shows a detail of a latch needle having a needle shank, a needle latch and a shortened damping spring in an open position.

FIG. 6 shows a detail of a latch needle 200 with a needle shank 202, a needle latch 204 and a shortened damping spring 206 in an open position. The freely resilient end of the contact portion 208 of the damping spring 206 is not aligned with the contact portion 210 of the needle shank 202, but rather within the contact portion 210. The connecting portion 212 of the damping spring 206 is arranged along the upper side of the needle 104 sloping towards the rear. As regards the rest, reference is made in particular to FIG. 1 through FIG. 5 and the associated description.

Figures 7A, 7B:
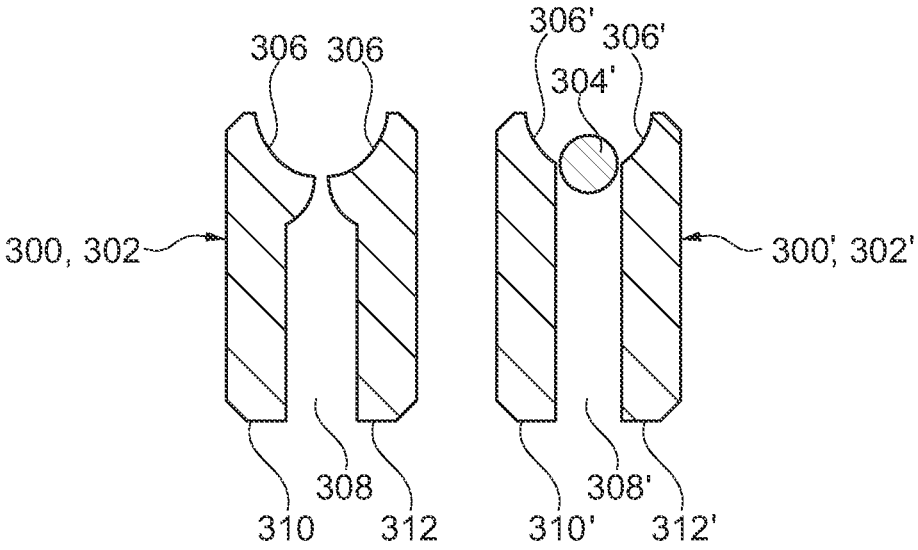
FIG. 7A shows a sectional view of a latch needle having a standard needle shank.
FIG. 7B shows a sectional view of a latch needle with a damping spring.

FIG. 7A shows a sectional view of a latch needle 300, such as latch needle 100 according to FIG. 1 through FIG. 5, and FIG. 7B shows a sectional view of a latch needle 300', such as latch needle 200 according to FIG. 6, with a needle shank 302, 302' and a damping spring 304'. The contact portion 306, 306' of the needle shank 302, 302', which is embodied as a shape impression by plastic deformation of the needle shank 302, 302' in portions, is evident. Each latch needle 300, 300' includes a slot 308, 308' between cheeks 310, 310', 312, 312'. In FIG. 7B, to accommodate the damping spring 304' in the slot 308' between the cheeks 310', 312', the slot 308' is milled through after the contact portion 306' has been produced. As regards the rest, reference is made in particular to FIG. 1 through FIG. 6 and the associated description.

Figure 8:
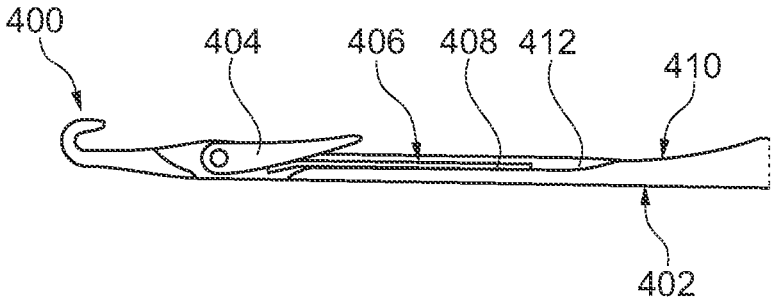
FIG. 8 shows a detail of a latch needle having a needle shank, a needle latch and a laterally flattened damping spring in an open position
Figure 9:
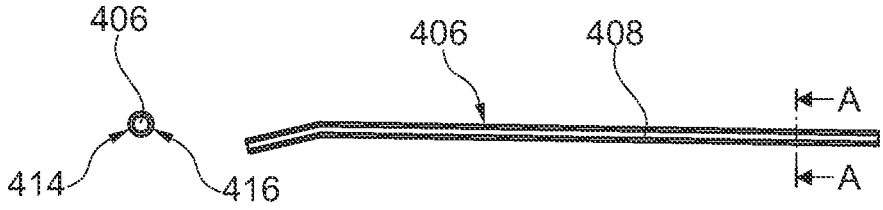
FIG. 9 shows a laterally flattened damping spring of a latch needle.

FIG. 8 shows a detail of a latch needle 400 with a needle shank 402, a needle latch 404 and a laterally flattened damping spring 406 in an open position. The connecting portion 408 of the damping spring 406 is received along the upper side of the needle 410, running approximately parallel to the latter, sunk deeply enough in the slot 412 that the damping spring 406 is spaced apart from the upper side of the needle 410. The distance of the damping spring 406 and the upper side of the needle 410 corresponds approximately to the height of the damping spring 406 on the connecting portion 408. FIG. 9 shows the laterally flattened damping spring 406 of the latch needle 400 in a side view and in a sectional view along the line A-A. The damping spring 406 is made of a round wire which is flattened on both sides before bending and insertion into the needle shank 402. This results in a cross-sectional area for the damping spring 406 with a specially adapted bending resistance moment; the lateral flattened regions 414, 416 allow improved fastening within the slot 412. As regards the rest, reference is made in particular to FIG. 1 through FIG. 7 and the associated description.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

LIST OF REFERENCE SYMBOLS

100 Latch needle
102 Needle back
104 Upper side of the needle
106 Needle shank
108 Needle hook
110 Needle latch
112 Damping spring
114 Closing portion
116 Slot
117 Back opening
118 Bearing journal
120 Pivot axis
122 Back
124 Closing portion
126 Contact portion
128 Contact portion
130 Connecting portion
132 Contact portion
200 Latch needle
202 Needle shank
204 Needle latch
206 Damping spring
208 Contact portion
210 Contact portion
212 Connecting portion
300 Latch needle
300' Latch needle
302 Needle shank
302' Needle shank
304 Damping spring
306 Contact portion
306' Contact portion
308 Slot
308' Slot
310 Cheek
310' Cheek
312 Cheek
312' Cheek
400 Latch needle
402 Needle shank
404 Needle latch
406 Damping spring
408 Connecting portion
410 Upper side of the needle
412 Slot
414 Flattened region
416 Flattened region

What is claimed is:

1. A latch needle for a loop-forming textile machine, the latch needle comprising:

a needle shank;

a needle latch with a back;

the needle shank having a slot for receiving the needle latch, and a first contact portion adapted to the back;

the needle latch pivotably mounted on the needle shank about a pivot axis for movement between an open position and a closed position;

wherein the back bears against the first contact portion of the needle shank in the open position of the needle latch; and a damping spring adapted to the back and/or the first contact portion, the damping spring configured to dampen a contact of the back of the needle latch against the first contact portion when the needle latch is in the open position, wherein the damping spring is not in contact with the needle latch when the needle latch is in the closed position.

2. The latch needle of claim 1, wherein:

the damping spring has a connecting portion cooperating with the needle shank and a second contact portion cooperating with the back of the needle latch and/or the first contact portion of the needle shank;

the connecting portion and the second contact portion being arranged at an angle to one another for adapting the damping spring to of the back and/or the first contact portion.

3. The latch needle of claim 2, wherein the angle is at least 15 degrees.

4. The latch needle of claim 3, wherein the angle is 20 degrees to 40 degrees.

5. The latch needle of claim 2, wherein the first contact portion and the second contact portion are arranged approximately parallel to one another.

6. The latch needle of claim 2, wherein the first contact portion and the second contact portion are arranged approximately parallel to one another.

7. The latch needle of claim 2, wherein the damping spring has an end on a second contact portion side, and the end is arranged in alignment with the first contact portion of the shank.

8. The latch needle of claim 2, further comprising:

a bearing journal pivotably mounting the needle latch on the needle shank;

wherein a parallel projection of the second contact portion on the bearing journal corresponds approximately to a diameter of the bearing journal.

9. The latch needle of claim 1, wherein:

the damping spring has a second contact portion corresponding to the back and/or the first contact portion; and the needle latch bears against the second contact portion over at least a quarter of a length of the needle latch in the open position of the needle latch.

10. The latch needle of claim 9, wherein the needle latch bears against the second contact portion over approximately one third of the length of the needle latch in the open position of the needle latch.

11. The latch needle of claim 1, configured such that, when the needle latch is placed in the open position with the aid of the damping spring, a maximum contact force between the back and the first contact portion can be reduced by 30 percent to 70 percent.

12. The latch needle of claim 11, wherein the maximum contact force can be reduced by approximately 50 percent.

13. A latch needle for a loop-forming textile machine, the latch needle comprising:

a needle shank;

a needle latch with a back;

the needle shank having a slot for receiving the needle latch, and a first contact portion adapted to the back;

the needle latch pivotably mounted on the needle shank about a pivot axis for movement between an open position and a closed position;

wherein the back bears against the first contact portion of the needle shank in the open position of the needle latch; and a damping spring adapted the back and/or the first contact portion, the damping spring configured to dampen a contact of the back of the needle latch against the first contact portion when the needle latch is in the open position, the damping spring comprising a freely resilient end and a connecting portion firmly connected to the needle shank.

14. The latch needle of claim 13, wherein the damping spring has the connecting portion cooperating with the needle shank and a second contact portion cooperating with the back of the needle latch and/or the first contact portion of the needle shank;

wherein the connecting portion and the second contact portion being arranged at an angle to one another for adapting the damping spring to of the back and/or the first contact portion; and wherein the angle is at least 15 degrees.

15. The latch needle of claim 14, wherein the first contact portion and the second contact portion are arranged approximately parallel to one another.

16. The latch needle of claim 14, further comprising:

a bearing journal pivotably mounting the needle latch on the needle shank;

wherein a parallel projection of the second contact portion on the bearing journal corresponds approximately to a diameter of the bearing journal.

17. The latch needle of claim 13, wherein the damping spring has an end on a second contact portion side, and the end is arranged in alignment with the first contact portion of the shank.

18. The latch needle of claim 13, wherein:

the damping spring has a second contact portion corresponding to the back and/or the first contact portion; and the needle latch bears against the second contact portion over at least a quarter of a length of the needle latch in the open position of the needle latch.

19. The latch needle of claim 13, configured such that, when the needle latch is placed in the open position with the aid of the damping spring, a maximum contact force between the back and the first contact portion can be reduced by 30 percent to 70 percent.

20. The latch needle of claim 13, wherein pivoting the needle latch about the pivot axis from the closed position to the open position causes the back to first come into mechanical contact with the damping spring and, subsequently, to bear against the first contact portion.

* * * * *